US011158953B2

(12) United States Patent
Foo

(10) Patent No.: US 11,158,953 B2
(45) Date of Patent: Oct. 26, 2021

(54) FLAT-PLATE, LOW SIDELOBE, TWO-DIMENSIONAL, STEERABLE LEAKY-WAVE PLANAR ARRAY ANTENNA

(71) Applicant: HUAWEI TECHNOLOGIES CO., LTD., Guangdong (CN)

(72) Inventor: Senglee Foo, Ottawa (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 52 days.

(21) Appl. No.: 16/815,207

(22) Filed: Mar. 11, 2020

(65) Prior Publication Data

US 2020/0295466 A1 Sep. 17, 2020

Related U.S. Application Data

(60) Provisional application No. 62/819,211, filed on Mar. 15, 2019.

(51) Int. Cl.
*H01Q 21/00* (2006.01)
*H01Q 13/20* (2006.01)
(Continued)

(52) U.S. Cl.
CPC ..... *H01Q 13/20* (2013.01); *H01Q 1/242* (2013.01); *H01Q 15/0086* (2013.01); *H01Q 21/065* (2013.01)

(58) Field of Classification Search
CPC .... H01Q 13/20; H01Q 15/0086; H01Q 1/242; H01Q 21/065; H01Q 13/206
See application file for complete search history.

(56) References Cited

U.S. PATENT DOCUMENTS 9,871,300 B1 1/2018 Lee et al.
10,581,158 B2 3/2020 Foo
(Continued)

FOREIGN PATENT DOCUMENTS

CN 105990688 A 10/2016
JP 2008054146 A 3/2008
(Continued)

OTHER PUBLICATIONS

Hoang V. Nguyen et al. Pencil-Beam Full-Space Scanning 2D CRLH Leaky-Wave Antenna Array, 2007 IEEE, pp. 139-142.
(Continued)

*Primary Examiner* — Dieu Hien T Duong
(74) *Attorney, Agent, or Firm* — BCF LLP

(57) ABSTRACT

A planar array antenna having a low-profile that provides a two dimensional, steerable, high-gain, low-sidelobe radiated RF beam patterns is presented. The antenna includes a metamaterial array of a plurality of first and second rows of unit cells, to propagate a radiation pattern along a first axis. The first rows operate in left-hand mode and the second rows operate in right-hand mode. Each of the unit cells include a volume of liquid crystal and a virtual ground connection capable of generating a potential difference for tuning the dielectric value of the liquid crystal. The antenna further includes a plurality of RF input ports disposed in a centralized location and a dual-channel center-feed network communicatively coupled to the plurality of paired first and second rows of unit cells and the plurality of RF input ports to form and control the direction of the radiated RF beam pattern.

16 Claims, 9 Drawing Sheets

(51) Int. Cl.

| | |
|---|---|
| ***H01Q 15/00*** | (2006.01) |
| ***H01Q 1/24*** | (2006.01) |
| ***H01Q 21/06*** | (2006.01) |

(56) References Cited

U.S. PATENT DOCUMENTS

| | | | | |
|---|---|---|---|---|
| 2007/0176827 | A1* | 8/2007 | Itoh | H01Q 21/08 343/700 MS |
| 2012/0274524 | A1* | 11/2012 | Piazza | H01Q 3/01 343/745 |

FOREIGN PATENT DOCUMENTS

| | | | |
|---|---|---|---|
| JP | 2016058839 | A | 4/2016 |
| WO | 2018173941 | A1 | 9/2018 |
| WO | 2019039004 | A1 | 2/2019 |

OTHER PUBLICATIONS

International Search Report and Written Opinion issued in corresponding application No. PCT/CN2020/079458 dated Jun. 9, 2020.

* cited by examiner

FLAT-PLATE, LOW SIDELOBE, TWO-DIMENSIONAL, STEERABLE LEAKY-WAVE PLANAR ARRAY ANTENNA

CROSS-REFERENCE TO RELATED APPLICATIONS

This application claims benefit to U.S. Provisional Application No. 62/819,211, entitled "FLAT-PLATE, LOW SIDELOBE, TWO-DIMENSIONAL, STEERABLE LEAKY-WAVE PLANAR ARRAY ANTENNA", filed on Mar. 15, 2019.

FIELD OF INVENTION

The present disclosure relates to array antennas. More specifically, the present disclosure relates to array antennas incorporating composite right-left-handed (CRLH) metamaterials.

BACKGROUND

Leaky-wave antennas incorporate a waveguide structure that provides low-level, Radio Frequency (RF) radiation along the length of a guiding structure. Leaky-wave antennas are employed in a number of applications including wireless communications (e.g., 5G networks), satellite communications, GPS systems, etc.

To ensure that the RF radiation is directed along a fixed direction, typical leaky-wave antennas require that, at a given frequency, the propagation constant of a radiated field along the waveguide structure be kept stable. As a result, conventional leaky-wave antennas typically have uniform aperture geometries. This configuration results in a natural exponential decay of amplitude from the feed point along the aperture of the antenna.

However, this asymmetrical amplitude tapering generally results in poor sidelobe performance along the radiation patterns for such antennas. Further, a typical leaky-wave antenna permits angular scanning and can only be steered to scan in approximately half of the available space (e.g., <90°), due to the inherent positive propagation constant of the antenna.

In addressing some of the noted issues regarding leaky-wave antennas, such as, for example, poor sidelobe performance, lack of beam steerability at a fixed frequency, etc., metamaterials (MTMs) have been considered for incorporation in the construction of antenna structures to exploit and control certain advantageous electromagnetic (EM) radiative properties.

MTMs consist of artificial structures that behave differently from naturally-occurring materials, the natural materials conventionally conforming to the right-hand propagation of EM radiation. As such, MTMs may be configured to operate in either or both of left-handed and right-handed modes. Such MTMs are referred to as composite right-left-handed (CRLH) MTMs. CRLH MTMs may be engineered using conventional dielectric and conductive materials to produce directional and steerable EM radiative properties.

SUMMARY

An object of the present disclosure describes a planar array antenna structure that provides for a low-profile, two dimensional, steerable, high-gain, low-sidelobe radiated RF beam. The planar array antenna incorporates composite right- and left-handed (CRLH) metamaterial antenna array configured to radiate a radio-frequency (RF) beam pattern that comprises a plurality of paired first and second rows of unit cells in which one of the first and second rows of unit cells is controllable to operate in a left-hand radiation mode, and the other of the first and second rows of unit cells is controllable to operate in a right-hand radiation mode, the plurality of paired first and second rows of unit cells are configured to propagate a radiation pattern along a first axis. Each of the unit cells include a volume of liquid crystal having a controllable dielectric value and at least one isolated ground patch configured as a virtual ground connection to enable a potential difference for controlling the dielectric value of the volume of liquid crystal.

The planar array antenna further incorporates a plurality of RF input ports disposed in a centralized location and a dual-channel center-feed network structure communicatively coupled to the plurality of paired first and second rows of unit cells and the plurality of RF input ports to form the RF beam pattern. The center feed network structure comprising a composite right- and left-handed (CRLH) metamaterial, a volume of liquid crystal having a controllable dielectric value, and at least one isolated ground patch configured as a virtual ground connection; and a metallic top enclosure covering a top side of the center feed network structure; wherein, the dual-channel center-feed network structure is configured to supply each of the plurality of RF input ports opposing phase information in a sequential manner, such that the one of the first and second rows of unit cells is controlled to operate in a left-hand radiation mode and the other of the first and second rows of unit cells is controlled to operate in a right-hand radiation mode.

In accordance with other aspects of the present disclosure, the antenna, wherein the plurality of paired first and second rows of unit cells are separated by a distance of one quarter or one half of an operating wavelength.

In accordance with other aspects of the present disclosure, the antenna, wherein each of the plurality of RF input ports are configured to be communicatively coupled to respective sections of the paired first and second rows of unit cells.

In accordance with other aspects of the present disclosure, the antenna, wherein the dual-channel center-feed network structure comprises a first dual-channel center-feed network and a second dual-channel center-feed network, in which each channel of the first and second dual-channel center-feed networks are communicatively coupled to one of the RF input ports.

In accordance with other aspects of the present disclosure, the antenna, wherein each channel of the first and second dual-channel center-feed networks is configured to sequentially supply each of the coupled RF input ports with alternating, opposite phase information.

In accordance with other aspects of the present disclosure, the antenna, wherein the dual-channel center-feed network structure is configured to apply predetermined control voltages to the first and second rows of unit cells to control a direction of the formed RF beam pattern.

In accordance with other aspects of the present disclosure, the antenna, wherein the dual-channel center-feed network structure applies lower level control voltages to the rows of unit cells operating in the right-hand radiation mode to control the formed RF beam pattern along a directional angle.

In accordance with other aspects of the present disclosure, the antenna, wherein the dual-channel center-feed network structure applies higher level control voltages to the rows of unit cells operating in the left-hand radiation mode to control the formed RF beam pattern along a directional angle.

In accordance with other aspects of the present disclosure, there is provided a wireless communication device comprising an antenna for receiving and transmitting wireless signals, the antenna comprising a composite right- and left-handed (CRLH) metamaterial antenna array configured to radiate a radio-frequency (RF) beam pattern, the CRLH metamaterial antenna array comprising a plurality of paired first and second rows of unit cells in which one of the first and second rows of unit cells is controllable to operate in a left-hand radiation mode, and the other of the first and second rows of unit cells is controllable to operate in a right-hand radiation mode, the plurality of paired first and second rows of unit cells configured to propagate a radiation pattern along a first axis and each of the unit cells in the plurality include a volume of liquid crystal having a controllable dielectric value and at least one isolated ground patch configured as a virtual ground connection to enable a potential difference for controlling the dielectric value of the volume of liquid crystal.

The wireless communication device further incorporates a plurality of RF input ports disposed in a centralized location and a dual-channel center-feed network structure communicatively coupled to the plurality of paired first and second rows of unit cells and the plurality of RF input ports to form the RF beam pattern. The center feed network structure comprising a composite right- and left-handed (CRLH) metamaterial, a volume of liquid crystal having a controllable dielectric value, and at least one isolated ground patch configured as a virtual ground connection; and a metallic top enclosure covering a top side of the center feed network structure; wherein, the dual-channel center-feed network structure is configured to supply each of the plurality of RF input ports opposing phase information in a sequential manner, such that the one of the first and second rows of unit cells is controlled to operate in a left-hand radiation mode and the other of the first and second rows of unit cells is controlled to operate in a right-hand radiation mode.

It is to be noted that directional references described herein such as "front", "rear", "up", "down", "horizontal", "top", "bottom", "side" and the like are used purely for convenience of description and do not limit the scope of the present disclosure. Furthermore, any dimensions provided herein are presented merely by way of an example and unless otherwise specified do not limit the scope of the disclosure. Furthermore, geometric terms such as "straight", "flat", "curved", "point" and the like are not intended to limit the disclosure any specific level of geometric precision, but should instead be understood in the context of the disclosure, taking into account normal manufacturing tolerances, as well as functional requirements as understood by a person skilled in the art.

BRIEF DESCRIPTION OF THE DRAWINGS

Reference will now be made, by way of example, to the accompanying drawings which show embodiments of the present application, and in which.

Similar reference numerals have been used in different figures to denote similar components.

DETAILED DESCRIPTION OF EMBODIMENTS

As will be described in greater detail below, the disclosed planar array antenna, in accordance with various embodiments, incorporates a plurality of bidirectional, one-dimensional, composite right-left-handed (CRLH) metamaterial (MTM) leaky-wave meta-arrays (CRLH LWAs). Each of the plurality of CRLH LWAs comprises multiple paired first and second rows of unit cells that are capable of radiating in both positive and negative wave propagation directions.

The CRLH LWAs include a liquid crystal (LC) loaded transmission line structure based on a modification to a grounded coplanar waveguide (GCPW), with a thin layer of additional substrate material over at least one surface. The volume of the LC is encapsulated using first and second substrates of the LWAs. The LC in the CRLH LWAs allows beam scanning over multiple RF frequencies or at a fixed RF frequency, over the full angular range including the broadside angle (i.e., zero degrees) to generate a steerable beam having relatively low sidelobes and relatively high gains in one dimension.

The planar array antenna also incorporates a dual-channel, right-left-handed, center-feed network and four RF input ports that are located in the center of the array and coupled to the center feed network. The dual-channel center-feed network can operate to provide opposite phase information to the four RF input ports to achieve two-dimensional, low-sidelobe, high-gain, steerable radiated RF beams.

Figure 1:
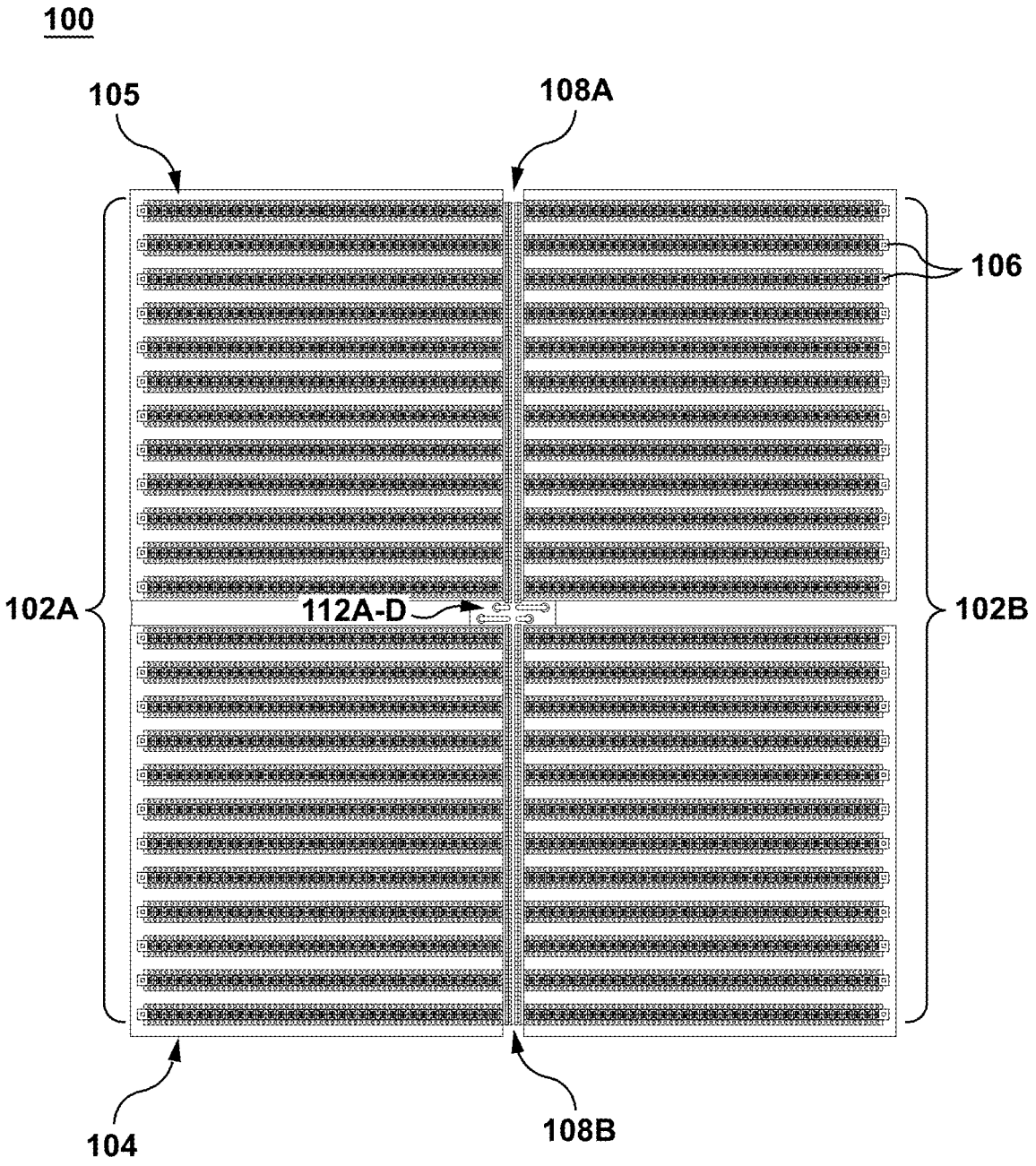
FIG. 1 depicts a top view of an exemplary planar array antenna, in accordance with the embodiments of the present disclosure.

Referring to the figures, FIG. 1 illustrates planar array antenna 100, in accordance with the embodiments provided by the present disclosure. As shown, planar array antenna 100 incorporates at least a first substrate 104 and a second substrate 105, in which first substrate 104 is implemented as an underneath (bottom) substrate and second substrate 105 implemented as a top substrate. The first (bottom) substrate 104 may include a conductive material printed onto that functions as a ground plane and includes a dielectric material that electrically isolates a surface of first substrate 104 from other surfaces. The surface of first (bottom) substrate 104 may be a layer included in a multilayer structure, such as, for example, a portion of a printed circuit board (PCB) or application board, in a wireless-capable device.

Planar array antenna 100 incorporates a plurality of paired rows of CRLH LWAs meta-arrays 102A, 102B that are disposed between the first and second substrates 104, 105. The CRLH LWAs 102A, 102B comprise multiple, sequential, unit cells 110 (see, FIG. 2). Each unit cell 110 includes a volume of liquid crystal (LC) 124 with a controllable dielectric value and one or more electrically isolated ground patches. The isolated ground patches are configured as one or more virtual ground connections capable of generating a potential difference in the volume of LC 124.

Figure 2:
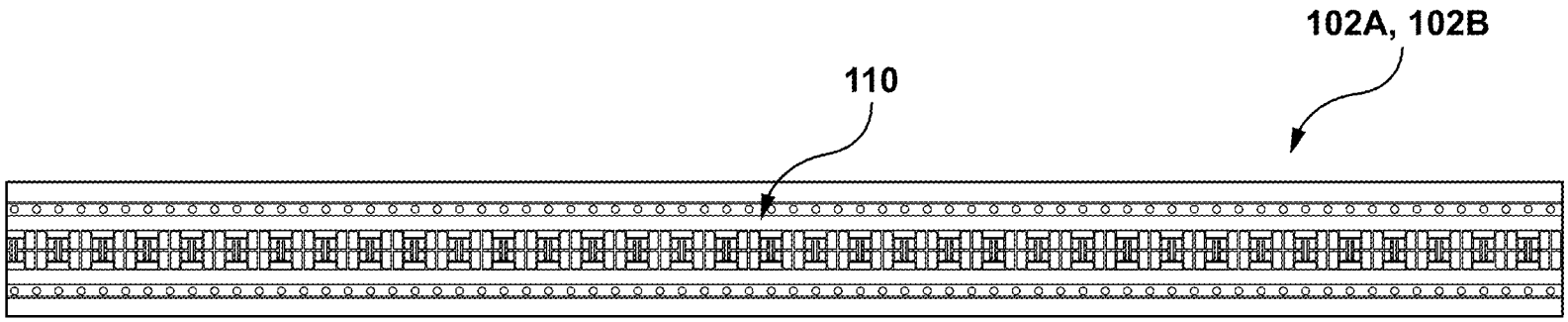
FIG. 2 depicts multiple, sequential, unit cells comprising metamaterial arrays, in accordance with the embodiments of the present disclosure.
Figure 3:
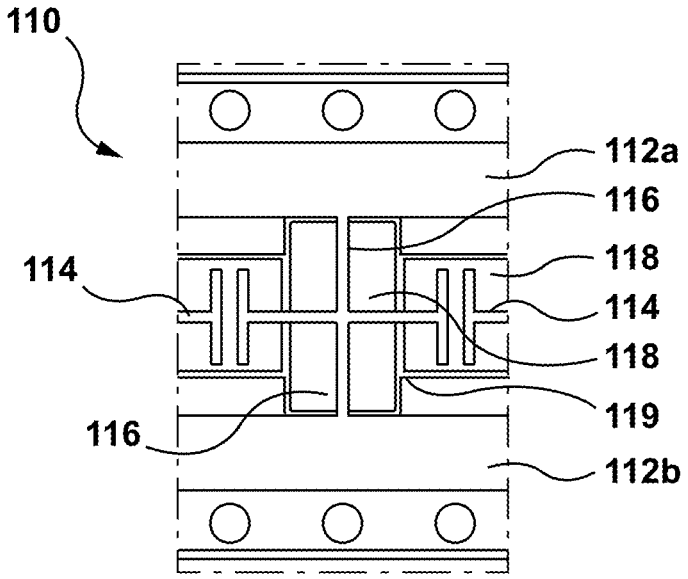
FIG. 3 depicts a top view of a unit cell structure, in accordance with the embodiments of the present disclosure.
Figure 4:
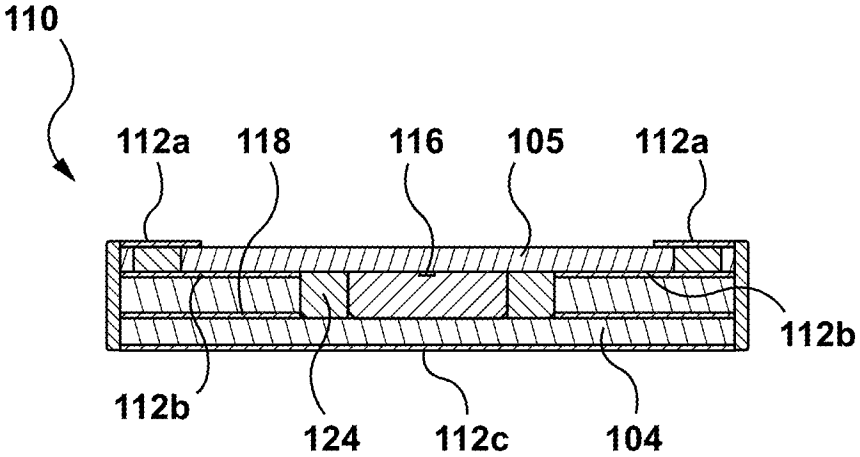
FIG. 4 depicts a side cross-sectional view of the unit cell structure, in accordance with the embodiments of the present disclosure.

In particular, FIG. 2 shows a representative segment of one row unit cells 110. Each row is made of one or more LC loaded CRLH unit cells 110 that repeat to form the MTM transmission line structure. An exemplary unit cell 110 is depicted by FIGS. 3, 4. FIG. 3 shows a top-down view of unit cell 110, and FIG. 4 shows a side cross-sectional view of the unit cell 110. The unit cell 110 includes portions of the first and second substrates 104, 105. In some embodiments, the first and second substrates 104, 105 are provided by a portion of a PCB or application board. In some embodiments, the first and second substrates 104, 105 are double-sided PCBs.

A volume of liquid crystal (LC) 124 is embedded between the first and second substrates 104, 105. In some embodiments, the LC is embedded in a cavity defined within the space between substrates 104 and 105. LC 124 is thus encapsulated between the first and second substrates 104, 105. Encapsulation of LC 124 within unit cells 110 of the CRLH LWA 102 may enable positive and negative electronic beam scanning, including scanning of the broadside angle (e.g., 0°). The other components of unit cell 110 may then be glued together and positioned within first and second substrates 104, 105. Thus, unit cell 110 may be more easily manufactured using a scalable process, such as, for example without requiring manual construction.

In some embodiments that are directed, for example, to non-uniform leaky-wave antennas, each of unit cells 110 of the CRLH LWAs 102 may have identical geometry and configurations. However, in at least other embodiments directed, for example, to non-uniform leaky wave antennas, one or more unit cells 110 of the CRLH LWAs 102 may have different geometries and configurations with different capacitors, inductors and/or positions of the virtual grounds. In some embodiments, the lengths of the pairs of first and second rows that make up the CRLH LWAs 102 are substantially equal.

The first and second substrates 104, 105 of the unit cell 110 are oriented in spaced opposition to each other and may align with each other to form a region that contains the volume of LC 124. In an example embodiment, first and second substrates 104, 105 and volume of LC 124 can be relatively thin, which may help to improve LC responses to an electrostatic field that may be applied to tune LC 124.

In certain embodiments, the volume of LC 124 may be a nematic liquid crystal or any other suitable liquid crystal. Where LC 124 is a nematic liquid crystal, the nematic liquid crystal may have an intermediate nematic gel-like state between solid crystalline and liquid phase at the intended operating temperature range of planar array antenna 100. Examples of suitable liquid crystals include, for example, GT3-23001 liquid crystal or BL038 liquid crystal from the Merck group. LC 124 may also possess dielectric anisotropy characteristics at microwave frequencies and the effective dielectric constant may be adjusted by setting different orientations of the molecules of LC 124 relative to its reference axis. Those skilled in the art will appreciate that a nematic state is one in which the liquid crystal elements are oriented a parallel fashion but without a requirement for them to form well defined planes.

The controlled changes to the electrostatic field between first and second substrates 104, 105 may result in changes to the dielectric properties of LC 124 that are noticeable at microwave frequencies. Thus, the effective dielectric constant can be tuned by varying the DC voltage applied to each unit cell 110, allowing the transmission phase of unit cells 110 to be controlled The unit 110 cell includes one or more ground planes 112*a*, 112*b*, 112*c* which may be provided on one or both sides of one or both of the first and second substrates 104, 105. Unit cell 110 includes two series capacitors 114 and two parallel inductors 116. Unit cell 110 also includes one or more isolated patches configured as virtual grounds 118 of unit cell 110. The virtual ground(s) 118 are located on one side (e.g. the top side) of the first substrate 104. The virtual ground(s) 118 are electrically isolated from DC by one or more slots 119. The planar series capacitor 114 and parallel inductor 116 are arranged similar to a grounded coplanar waveguide (GCPW) configuration. As shown in FIG. 3, unit cell 110 includes the series capacitors 114 providing electrical coupling in series between adjacent unit cells 110. Unit cell 110 also includes the parallel inductors 116 provide parallel electrical coupling to ground.

In the embodiment shown in FIGS. 3, 4, parallel inductors 116 and planar capacitors 114 are DC-grounded via a DC ground plane of unit cell 110, which may be one or more of the ground planes 112*a*, 112*b*, 112*c*. Thus, isolated patches of the virtual ground 118 provide a means of introducing a DC-bias voltage to tune LC 124. To introduce a potential difference in the volume of LC 124 between the first and second substrates 104, 105, the virtual ground planes 118 may be provided on one side (e.g. the top side) of first substrate 104 and positioned directly under series capacitor 114 and parallel inductors 116, as shown in FIG. 4. The isolated patches of the virtual ground 118 may be used as a substitute for an open microstrip transmission structure. Conventional microstrip transmission structures tend to require additional layers of substrate material. At higher operating frequencies, such as millimeter wave frequencies (e.g., as proposed for 5G communications), the additional substrate material can result in spurious transmission modes.

It will be appreciated that the configuration of virtual ground 118 enables control of static field strength in the volume of LC 124, by enabling appropriate DC control voltages to be applied for electrically tuning the volume of LC 124. The isolated patches of virtual ground 118 act as a virtual RF ground and permit changes of electrostatic field in the volume of LC 124 to achieve beam steering functionality. In operation, virtual grounds 118 isolate the path of the DC current while allowing RF signals to propagate. Each isolated patch of virtual ground 118 may operate as an isolated ground at low frequencies while operating as a relatively continuous ground at high frequencies. Incorporation of the virtual grounds 118 in unit cells 110 of CRLH MTM arrays 102A, 102B and the GCPW configuration of unit cell 110 enables the introduction of DC voltages in the volume of LC 124 to realize beam steering functionality.

Figure 5:
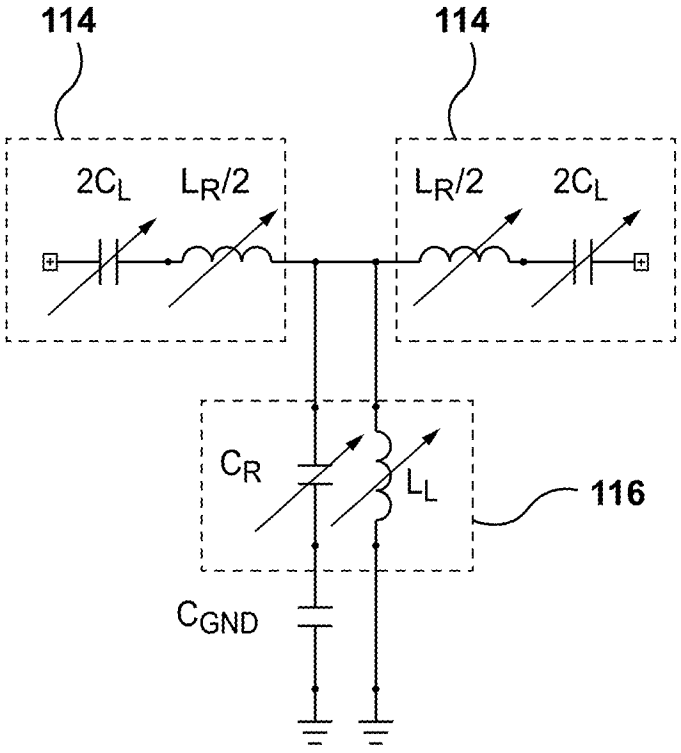
FIG. 5 depicts an equivalent circuit representation of an example of a composite right-left-handed (CRLH) metamaterial (MTM) array unit cell, in accordance with the embodiments of the present disclosure

Reference is made to FIG. 5, which shows an equivalent circuit representation of the example CRLH MTM array unit cell 110 of FIGS. 3, 4. In the disclosed embodiment, unit cell 110 includes series capacitors 114 and parallel inductors 116 with finite length transmission lines. With the inherent right-hand circuit parameters in the finite transmission line length, the unit cell 110 can be characterized by four circuit parameters, namely right-hand capacitance $C_R$, left-hand capacitance $C_L$, right-hand inductance $L_R$ and left-hand inductance $L_L$.

The dimensions of capacitors 114 and inductors 116 may be selected using simulation software (e.g., using iterative calculations) such as High Frequency Structure Simulator (HFSS) to generate the desired right-hand and left-hand capacitances and inductances ($C_L$, $C_R$, $L_L$, $L_R$). In example simulations, the transition frequency of the unit cell may be calculated using the following example equation:

$$\omega_0 = \sqrt{\omega_R \omega_L}\text{; where } \omega_R = \frac{1}{\sqrt{L_R C_R}},\ \omega_L = \frac{1}{\sqrt{L_L C_L}}$$

Further, in example simulations where planar array antenna 100 is operating in balanced mode (i.e., when the series resonant frequency $\omega_{se}$ is approximately equal to the shunt resonance frequency $\omega_{sh}$), the series and shunt resonance frequencies, respectively, my be calculated as follows:

$$\text{series resonance frequency } \omega_{se} = \frac{1}{\sqrt{L_R C_L}}$$

$$\text{shunt resonance frequency } \omega_{sh} = \frac{1}{\sqrt{L_L C_R}}$$

The above parameters are variable depending on the geometries of the structure and effective dielectric constant ($E_R$) of LC 124 embedded between the first and second substrates 104, 105 which can be tuned as described herein. It will be appreciated that, in general, any suitable capacitor and inductor configurations may be used as part of unit cell 110.

When planar array antenna 100 is in operation, LC 124 may be controlled such that antenna 100 achieves the maximum scan angle when the effective dielectric constant is set at the lowest value (e.g., 2.5). The antenna 100 may be controlled so that the radiation beam is slowly scanned from the initial angle through the broadside angle (i.e., 0°) to the opposite angular space as the dielectric constant increases (e.g., from 2.5 to 3.3).

As noted above, each of the unit cells 110 is configured to have an RF propagation direction along a first axis (e.g., longitudinal or transverse axis) of the first substrate 104, and are paired and oriented end-to-end, such that they are separated by a distance 106 along the first axis of the first substrate 104, in accordance with the operating wavelength $\lambda_{op}$ of planar array antenna 100. In certain embodiments, distance 106 may be configured to be on the order of $\lambda_{op}/4$ or $\lambda_{op}/2$.

In various embodiments, each of the row-paired CRLH LWAs 102A, 102B are configured to operate in opposite propagation directions by being fed proper phase information. That is, each row of unit cells 110 may be phase-controlled by being supplied opposite phase information, such that one row of the pair of unit cells operates substantially in a left-hand mode and the other row of unit cells operates substantially in the right-hand mode. This opposite phase approach enables the beam forming of a high-gain, low-sidelobe radiation pattern in two dimensions.

Figure 6:
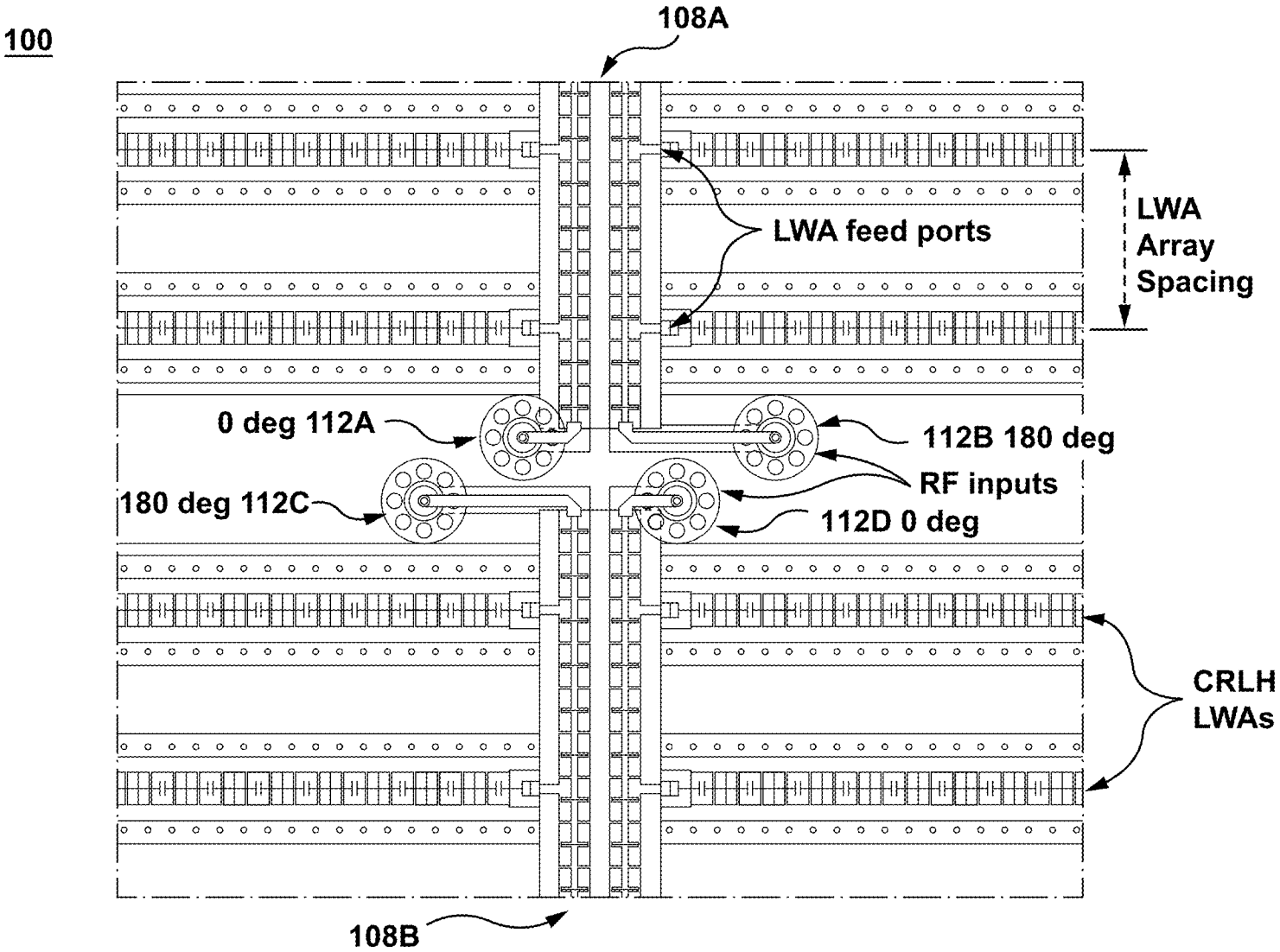
FIG. 6 depicts the connectivity of a representative dual-channel, center-feed network to RF feed inputs of planar array antenna, in accordance with the embodiments of the present disclosure.

Regarding beam formation, FIG. 6 depicts the connectivity of a representative dual-channel, center-feed network 108 to RF feed input ports 112A-D of planar array antenna 100, in accordance with the embodiments of the present disclosure. As shown, planar array antenna 100 incorporates a first dual-channel, right-left-handed (RLH) center-feed network 108A, a second dual-channel, RLH center-feed network 108B. Antenna 100 further incorporates four RF feed input ports 112A-D that are disposed in the center of array antenna 100 and are respectively coupled to center-feed networks 108A, 108B. The dual-channel center-feed networks 108A, 108B are configured to provide controlling, properly-phased RF signal information to the RF feed input ports 112A-D to achieve two-dimensional, high-gain, low-sidelobe, radiated RF beams.

Figure 7:
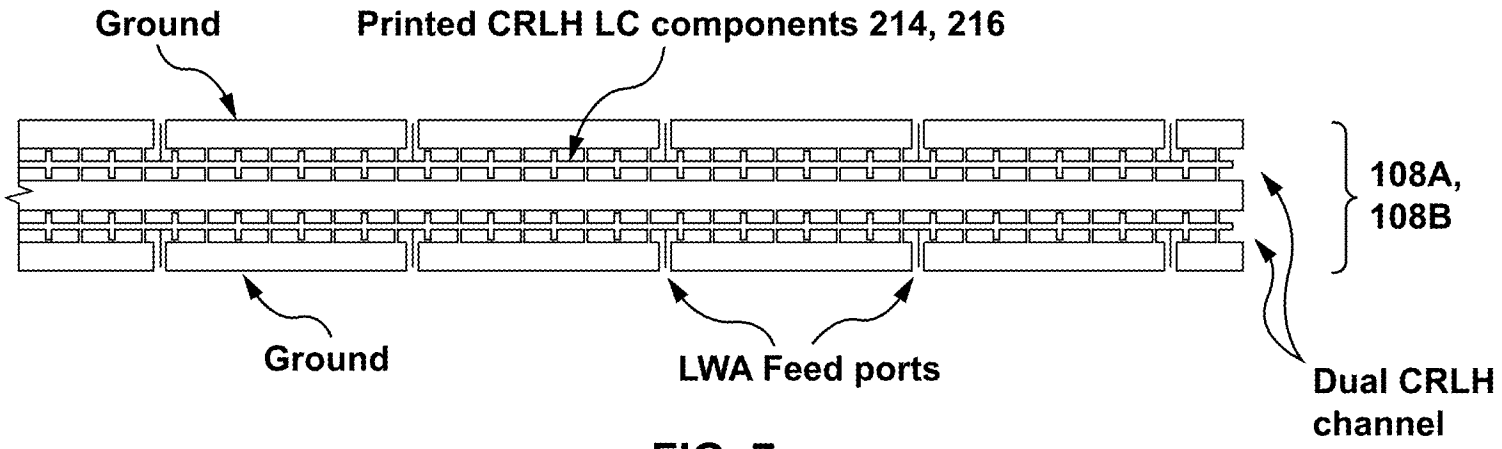
FIG. 7 depicts a structural top view of the representative dual-channel, center-feed network, in accordance with the embodiments of the present disclosure.
Figure 8:
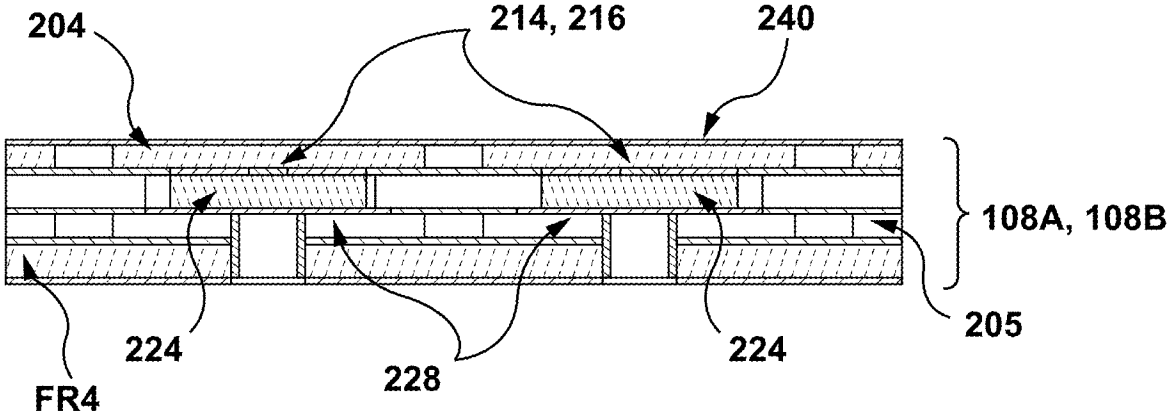
FIG. 8 depicts a structural cross-sectional side view of the representative dual-channel, center-feed network, in accordance with the embodiments of the present disclosure.

FIGS. 7, 8 respectively depict a structural top view and cross-sectional side view of dual-channel, RLH center-feed network 108A/108B, in accordance with the embodiments of the present disclosure. As shown, the structure of dual-channel, RLH center-feed networks 108A, 108B comprises liquid-crystal-loaded CRLH metamaterial structure similar to that of the leaky-wave CRLH MTM arrays 102A, 102B. Namely, networks 108A, 108B include first and second substrates 204, 205, respectively, that may be provided by a portion of a PCB or application board, and a volume of LC 224 embedded in a cavity between the first and second substrates 204, 205. Networks 108A, 108B further include printed liquid-crystal-loaded CRLH components 214, 216 and isolated patches configured as virtual grounds 218 disposed on the top side of first substrate 204.

However, in contrast to the CRLH MTM arrays 102A, 102B, it is undesirable for RLH center-feed networks 108A, 108B to exhibit any radiation along the transmission media. As such, an additional metallic top enclosure or cover 240 is placed over the top side of networks 108A, 108B to prevent any undesirable radiation. In this case, the CRLH transmission characteristic may be adjusted to provide the required progressive phases along the propagation direction of networks 108A, 108B.

Returning to FIG. 6, the dual channel RLH feed networks 108A, 108B are respectively coupled to RF feed input ports 112A-D that are associated with different rows of CRLH MTM arrays 102A, 102B. In the illustrated embodiment, one channel of one of the RLH feed networks 108A, 108B is coupled to one of the RF feed input ports 112A-D, respectively. This configuration enables RLH feed networks 108A, 108B to provide, in a sequential, rotational manner, opposite phase information (e.g., 0°, 180°, 0°, 180°) to each of the RF feed input ports 112A-D. In this opposite phase-feeding approach, one side of CRLH MTM arrays 102A, 102B will operate in the right-hand transmission mode while the other side of CRLH MTM arrays 102A, 102B will operate in the left-hand transmission mode. By feeding the RF feed input ports 112A-D with opposite phase information, CRLH LWAs 102A, 102B are able to efficiently radiate in four separate orientations (i.e., right-right, right-left, left-left, left-right), resulting in a radiation field having a natural exponential decay in all directions from the center feed point. In so doing, a two-dimensional, high-gain, low side-lobe RF beam pattern may be realized in all directions.

In various embodiments, the directional steering of the radiated, high-gain, low-sidelobe RF beam generated by CRLH LWAs 102A, 102B may be guided and controlled by the use of appropriate DC control voltages. As noted above, the virtual grounds 118 and GCPW structure of the unit cells 110 (constituting the CRLH LWAs arrays 102A, 102B) allow for the introduction of DC voltages to the volume of LC 124 to enable beam steering operations. As such, the angular direction of the radiated RF beam may be guided and controlled by the application of four DC control voltages coupled to the virtual grounds 118 of CRLH LWAs arrays 102A, 102B.

Figure 9:
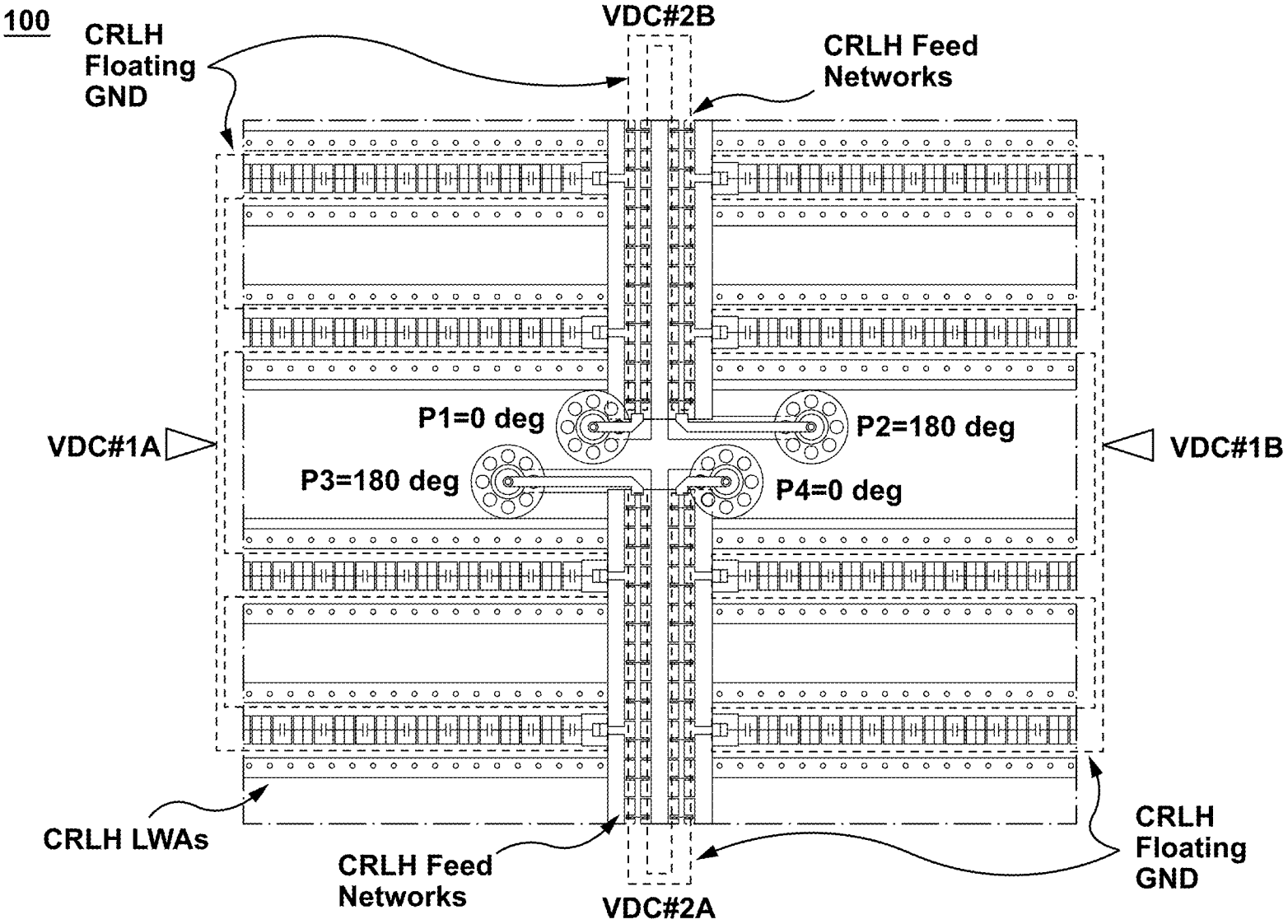
FIG. 9 depicts application of DC control voltages to planar array antenna for steering control of radiated RF beams, in accordance with the embodiments of the present disclosure.
Figure 10:
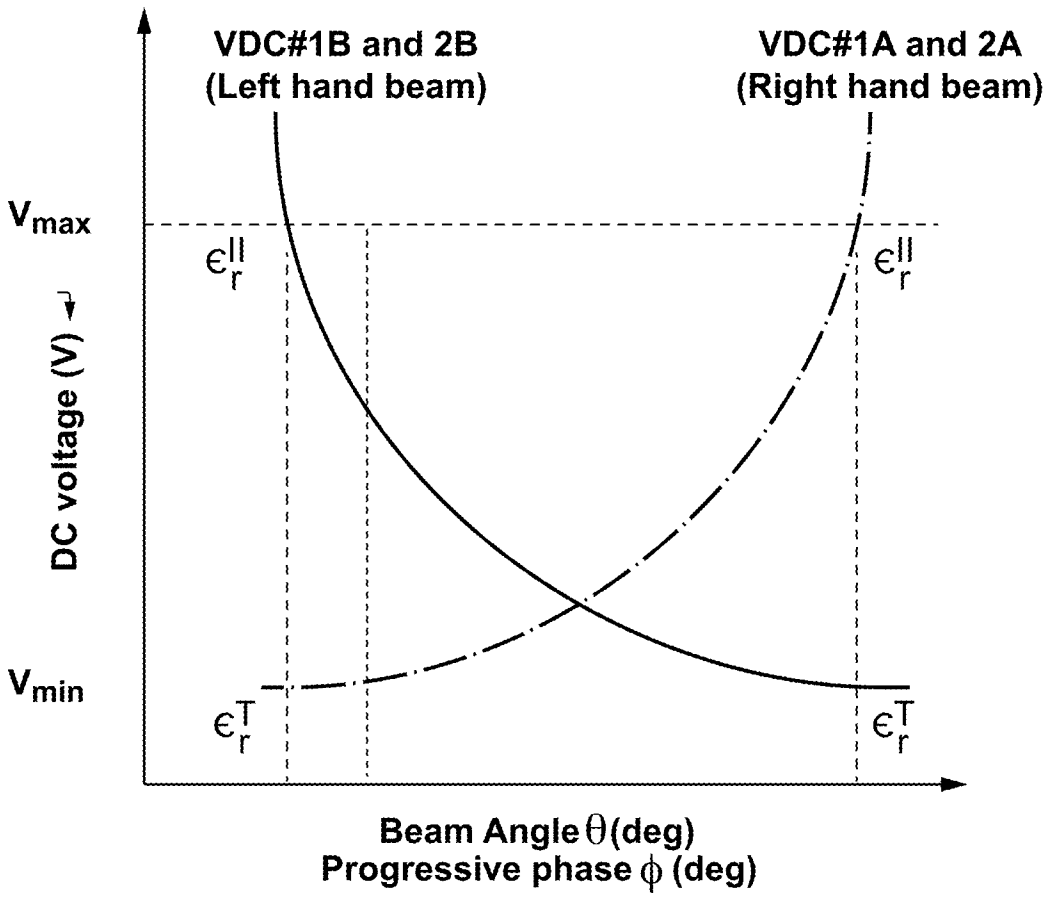
FIG. 10 depicts characteristics of the DC control voltages for the steering control of the radiated RF beams, in accordance with the embodiments of the present disclosure.

FIG. 9 depicts application of DC control voltages to elements of planar array antenna 100 for the steering control of radiated RF beams, in accordance with the embodiments of the present disclosure. As shown, the DC control voltages operate in pairs: (a) VDC 1A, 1B applied to virtual ground 118 of CRLH MTM arrays 102A, 102B; and (b) VDC 2A, 2B applied to the virtual ground of dual channel RLH feed networks 108A, 108B. FIG. 10 depicts representative DC control voltage characteristics for the RF beam steering of planar array antenna 100, in accordance with the embodiments of the present disclosure. In the disclosed embodiments, the DC control voltages for the left-handed and right-handed CRLH MTM arrays 102B are applied in tandem. For example, at low beam angles, right-handed CRLH MTM arrays 102B operate with low DC control voltages (e.g., VDC 1A=$V_{min}$), so that the LC directors of these arrays are perpendicular to the desired polarization of the radiated field. In other words, the effective permittivity $\varepsilon_r^{eff}$ of the LC approximates the perpendicular permittivity $\varepsilon^T$ of the LC for low beam angles of the right-handed CRLH MTM arrays 102B.

Concurrently, the left-handed CRLH MTM arrays 102A operate with high DC control voltages (e.g., VDC 1B=$V_{max}$), so that the LC directors of these arrays are parallel to the desired polarization of the radiated field, namely, the effective permittivity $\varepsilon_r^{eff}$ of the LC approximates parallel permittivity $\varepsilon^{\parallel}$ of the LC, and vice versa. Similarly, DC control voltages VDC 2A, 2B operate in the same manner for beam steering in the vertical direction.

It will be appreciated that the embodiments of planar array antenna 100, as disclosed herein, offer a number of advantages over conventional leaky-wave antenna array structures. For example, conventional full-phased array antennas typically require multiple (in some instances, hundreds and thousands) of independent RF ports, separate baseband feed controls, and DC control line connections to achieve full two-dimensional RF beam functionality.

In contrast, the presently disclosed structural embodiments of CRLH MTM arrays ys 102A, 102B and dual-channel RLH feed networks 108A, 108B are configured to achieve a two dimensional, steerable, high-gain, low-side-lobe radiated RF beam by using only four independent DC control lines and four RF ports.

Equally notable, the disclosed structural embodiments of planar array antenna 100 provide for a very low height profile, as both the CRLH MTM arrays 102A, 102B and dual-channel RLH feed networks 108A, 108B, are made of compact, low profile circuitry (e.g., thickness on the order of millimeters). In so doing, planar array antenna 100 may be implemented in a variety of devices, such as, for example, mobile communication devices, satellite communication devices, wireless routers, base stations, access points, a client terminal in a wireless communication network and other wireless and telecommunication devices and applications. Such devices may be employed in a stationary or mobile environment and may be implemented for communications within 5G communication networks or other wireless communication networks.

Figure 11:
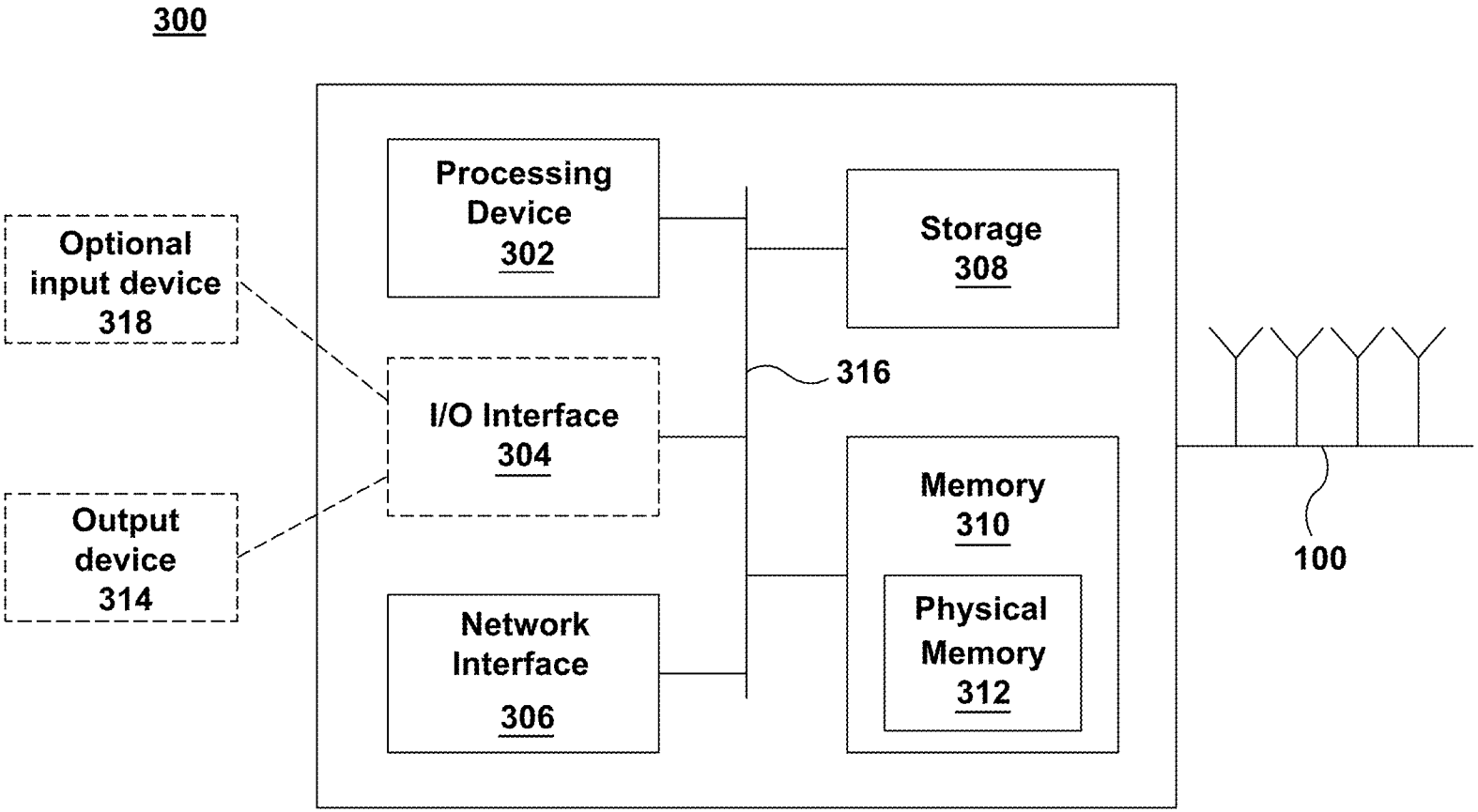
FIG. 11 is a schematic diagram of an example wireless communication device, in which examples of the planar array antenna described herein may be used, in accordance with the embodiments of the present disclosure.

FIG. 11 is a schematic diagram of an example wireless communication device 300, in which examples of the planar array antenna 100 described herein may be used, in accordance with the embodiments of the present disclosure. For example, the wireless communication device 300 may be a base station, an access point, or a client terminal in a wireless communication network. The wireless communication device 300 may be used for communications within 5G communication networks or other wireless communication networks. Although FIG. 11 shows a single instance of each component, there may be multiple instances of each component in the wireless communication device 300. The wireless communication device 300 may be implemented using parallel and/or distributed architecture.

The wireless communication device 300 may include one or more processing devices 302, such as a processor, a microprocessor, an application-specific integrated circuit (ASIC), a field-programmable gate array (FPGA), a dedicated logic circuitry, or combinations thereof. The wireless communication device 300 may also include one or more optional input/output (I/O) interfaces 304, which may enable interfacing with one or more optional input devices 318 and/or output devices 314. The wireless communication device 300 may include one or more network interfaces 306 for wired or wireless communication with a network (e.g., an intranet, the Internet, a P2P network, a WAN and/or a LAN, and/or a Radio Access Network (RAN)) or other node. The network interface(s) 306 may include one or more interfaces to wired networks and wireless networks. Wired networks may make use of wired links (e.g., Ethernet cable). The network interface(s) 306 may provide wireless communication (e.g., full-duplex communications) via an example of the planar array antenna 100. The wireless communication device 300 may also include one or more storage units 308, which may include a mass storage unit such as a solid state drive, a hard disk drive, a magnetic disk drive and/or an optical disk drive.

The wireless communication device 300 may include one or more memories 310 that can include a physical memory 312, which may include a volatile or non-volatile memory (e.g., a flash memory, a random access memory (RAM), and/or a read-only memory (ROM)). The non-transitory memory(ies) 310 (as well as storage 308) may store instructions for execution by the processing device(s) 302. The memory(ies) 310 may include other software instructions, such as for implementing an operating system (OS), and other applications/functions. In some examples, one or more data sets and/or modules may be provided by an external memory (e.g., an external drive in wired or wireless communication with the wireless communication device 300) or may be provided by a transitory or non-transitory computer-readable medium. Examples of non-transitory computer readable media include a RAM, a ROM, an erasable programmable ROM (EPROM), an electrically erasable programmable ROM (EEPROM), a flash memory, a CD-ROM, or other portable memory storage.

There may be a bus 316 providing communication among components of the wireless communication device 300. The bus 316 may be any suitable bus architecture including, for example, a memory bus, a peripheral bus or a video bus. Optional input device(s) 318 (e.g., a keyboard, a mouse, a microphone, a touchscreen, and/or a keypad) and optional output device(s) 314 (e.g., a display, a speaker and/or a printer) are shown as external to the wireless communication device 300, and connected to optional I/O interface 304. In other examples, one or more of the input device(s) 1035 and/or the output device(s) 314 may be included as a component of the wireless communication device 300.

The processing device(s) 302 may be used to control communicate transmission/reception signals to/from the planar array antenna 100. The processing device(s) 302 may be used to control beam steering by the planar array antenna 100, for example by controlling the voltage applied to the isolated ground of the unit cells, for tuning the encapsulated liquid crystal. The processing device(s) 302 may also be used to control the phase of the phase variable lens, in order to steer the antenna beam over a 2D plane. The inventive descriptions and concepts provided by the present disclosure may be embodied in other specific forms without departing from the subject matter of the claims. The described embodiments are to be considered in all respects as being only illustrative and not restrictive. Various modifications and combinations of the illustrative embodiments, as well as other embodiments of the invention, will be apparent to persons skilled in the art upon reference to the description. Selected features from one or more of the above-described embodiments may be combined to create alternative embodiments not explicitly described, features suitable for such combinations being understood within the scope of this disclosure.

It will also be understood that, although the inventive concepts and principles presented herein have been described with reference to specific features, structures, and embodiments, it is clear that various modifications and combinations may be made without departing from such disclosures. The specification and drawings are, accordingly, to be regarded simply as an illustration of the inventive concepts and principles as defined by the appended claims, and are contemplated to cover any and all modifications, variations, combinations or equivalents that fall within the scope of the present disclosure.

What is claimed is:

1. An antenna comprising:

a composite right- and left-handed (CRLH) metamaterial antenna array configured to radiate a radio-frequency (RF) beam pattern, the CRLH metamaterial antenna array comprising:

a plurality of paired first and second rows of unit cells in which one of the first and second rows of unit cells is controllable to operate in a left-hand radiation mode, and the other of the first and second rows of unit cells is controllable to operate in a right-hand radiation mode, the plurality of paired first and second rows of unit cells configured to propagate a radiation pattern along a first axis; and each of the unit cells in the plurality include a volume of liquid crystal having a controllable dielectric value and at least one isolated ground patch configured as a virtual ground connection to enable a potential difference for controlling the dielectric value of the volume of liquid crystal;

a plurality of RF input ports disposed in a centralized location;

a dual-channel center-feed network structure communicatively coupled to the plurality of paired first and second rows of unit cells and the plurality of RF input ports to form the RF beam pattern, the center feed network structure comprising:

a composite right- and left-handed (CRLH) metamaterial, a volume of liquid crystal having a controllable dielectric value, and at least one isolated ground patch configured as a virtual ground connection; and a metallic top enclosure covering a top side of the center feed network structure;

wherein, the dual-channel center-feed network structure is configured to supply each of the plurality of RF input ports opposing phase information in a sequential manner, such that the one of the first and second rows of unit cells is controlled to operate in a left-hand radiation mode and the other of the first and second rows of unit cells is controlled to operate in a right-hand radiation mode.

2. The antenna of claim 1, wherein the plurality of paired first and second rows of unit cells are separated by a distance of one quarter or one half of an operating wavelength.

3. The antenna of claim 1, wherein each of the plurality of RF input ports are configured to be communicatively coupled to respective sections of the paired first and second rows of unit cells.

4. The antenna of claim 1, wherein the dual-channel center-feed network structure comprises a first dual-channel center-feed network and a second dual-channel center-feed network, in which each channel of the first and second dual-channel center-feed networks are communicatively coupled to one of the RF input ports.

5. The antenna of claim 4, wherein each channel of the first and second dual-channel center-feed networks is configured to sequentially supply each of the coupled RF input ports with alternating, opposite phase information.

6. The antenna of claim 1, wherein the dual-channel center-feed network structure is configured to apply predetermined control voltages to the first and second rows of unit cells to control a direction of the formed RF beam pattern.

7. The antenna of claim 6, wherein the dual-channel center-feed network structure applies lower level control voltages to the rows of unit cells operating in the right-hand radiation mode to control the formed RF beam pattern along a directional angle.

8. The antenna of claim 6, wherein the dual-channel center-feed network structure applies higher level control voltages to the rows of unit cells operating in the left-hand radiation mode to control the formed RF beam pattern along a directional angle.

9. A wireless communication device comprising:

an antenna for receiving and transmitting wireless signals, the antenna comprising:

a composite right- and left-handed (CRLH) metamaterial antenna array configured to radiate a radio-frequency (RF) beam pattern, the CRLH metamaterial antenna array comprising:

a plurality of paired first and second rows of unit cells in which one of the first and second rows of unit cells is controllable to operate in a left-hand radiation mode, and the other of the first and second rows of unit cells is controllable to operate in a right-hand radiation mode, the plurality of paired first and second rows of unit cells configured to propagate a radiation pattern along a first axis; and each of the unit cells in the plurality include a volume of liquid crystal having a controllable dielectric value and at least one isolated ground patch configured as a virtual ground connection to enable a potential difference for controlling the dielectric value of the volume of liquid crystal;

a plurality of RF input ports disposed in a centralized location;

a dual-channel center-feed network structure communicatively coupled to the plurality of paired first and second rows of unit cells and the plurality of RF input ports to form the RF beam pattern, the center feed network structure comprising:

a composite right- and left-handed (CRLH) metamaterial, a volume of liquid crystal having a controllable dielectric value, and at least one isolated ground patch configured as a virtual ground connection; and a metallic top enclosure covering a top side of the center feed network structure;

wherein, the dual-channel center-feed network structure is configured to supply each of the plurality of RF input ports opposing phase information in a sequential manner, such that the one of the first and second rows of unit cells is controlled to operate in a left-hand radiation mode and the other of the first and second rows of unit cells is controlled to operate in a right-hand radiation mode.

10. The wireless communication device of claim 9, wherein the plurality of paired first and second rows of unit cells are separated by a distance of one quarter or one half of an operating wavelength.

11. The wireless communication device of claim 9, wherein each of the plurality of RF input ports are configured to be communicatively coupled to respective sections of the paired first and second rows of unit cells.

12. The wireless communication device of claim 9, wherein the dual-channel center-feed network structure comprises a first dual-channel center-feed network and a second dual-channel center-feed network, in which each channel of the first and second dual-channel center-feed networks are communicatively coupled to one of the RF input ports.

13. The wireless communication device of claim 12, wherein each channel of the first and second dual-channel center-feed networks is configured to sequentially supply each of the coupled RF input ports with alternating, opposite phase information.

14. The wireless communication device of claim 9, wherein the dual-channel center-feed network structure is configured to apply predetermined control voltages to the first and second rows of unit cells to control a direction of the formed RF beam pattern.

15. The wireless communication device of claim 14, wherein the dual-channel center-feed network structure applies lower level control voltages to the rows of unit cells operating in the right-hand radiation mode to control the formed RF beam pattern along a directional angle.

16. The wireless communication device of claim 14, wherein the dual-channel center-feed network structure applies higher level control voltages to the rows of unit cells operating in the left-hand radiation mode to control the formed RF beam pattern along a directional angle.

* * * * *